US007748962B2

(12) United States Patent
Haeberle et al.

(10) Patent No.: US 7,748,962 B2
(45) Date of Patent: Jul. 6, 2010

(54) FLUID HANDLING APPARATUS AND METHOD OF HANDLING A FLUID

(75) Inventors: Stefan Haeberle, Freiburg (DE); Jens Ducrée, Freiburg (DE); Roland Zengerle, Waldkirch (DE); Norbert Schmitt, Freiburg (DE)

(73) Assignee: Albert-Ludwigs-Universitaet Freiburg, Freiburg (DE)

( * ) Notice: Subject to any disclaimer, the term of this patent is extended or adjusted under 35 U.S.C. 154(b) by 689 days.

(21) Appl. No.: 11/624,493

(22) Filed: Jan. 18, 2007

(65) Prior Publication Data

US 2007/0189910 A1 Aug. 16, 2007

(30) Foreign Application Priority Data

Jan. 20, 2006 (DE) ..... 10 2006 002 924

(51) Int. Cl.
*F04B 43/00* (2006.01)
*F04B 45/00* (2006.01)

(52) U.S. Cl. ..... 417/412; 417/413.1; 417/420; 417/322

(58) Field of Classification Search ..... 417/412, 417/413.1, 413.2, 322, 477.1–477.14, 474, 417/475, 476, 50, 420; 74/22 A
See application file for complete search history.

(56) References Cited

U.S. PATENT DOCUMENTS 3,066,853 A * 12/1962 Landenberger ..... 417/360
3,089,425 A * 5/1963 Sprague et al. ..... 417/413.1
3,992,132 A * 11/1976 Putt ..... 417/271
5,315,968 A * 5/1994 Niebrzydoski ..... 123/73 C
5,554,012 A * 9/1996 Itakura ..... 417/410.1
6,227,824 B1 5/2001 Stehr
6,415,534 B1 * 7/2002 Liao ..... 40/407
6,971,141 B1 * 12/2005 Tak ..... 15/340.1

(Continued)

FOREIGN PATENT DOCUMENTS

| | | |
|---|---|---|
| DE | 4118628 | 12/1992 |
| DE | 4244619 | 7/1994 |
| EP | 1065378 | 1/2001 |

(Continued)

OTHER PUBLICATIONS

"A ball valve micropump in glass fabricated by powder blasting", Christophe Yamahata, et al., Science @Direct, Sensors and Actuators, B 110 (2005) 1-7.

(Continued)

*Primary Examiner*—Devon C Kramer
*Assistant Examiner*—Christopher Bobish
(74) *Attorney, Agent, or Firm*—Dicke, Billig & Czaja, PLLC

(57) ABSTRACT

A fluid handling apparatus includes a body, which comprises a fluid handling structure, and a flexible membrane attached to the body and formed to interact with a fluid in the fluid handling structure, wherein the membrane comprises a first actuation component. A second actuation component is provided, wherein the first and the second actuation component are formed such that the same attract or repel each other in a first positional relationship, in order to actuate the flexible membrane. A driving means is provided to move the body relative to the second actuation component, in order to bring the first and the second actuation component into the first and out of the first positional relationship.

11 Claims, 4 Drawing Sheets

U.S. PATENT DOCUMENTS

| | | | | |
|---|---|---|---|---|
| 7,393,188 | B2 * | 7/2008 | Lawyer et al. | 417/420 |
| 2002/0098097 | A1 * | 7/2002 | Singh | 417/413.1 |
| 2004/0141851 | A1 * | 7/2004 | Hite | 417/61 |
| 2006/0051218 | A1 * | 3/2006 | Harttig | 417/412 |

FOREIGN PATENT DOCUMENTS

| | | |
|---|---|---|
| EP | 1065378 | 4/2004 |
| WO | 9710435 | 3/1997 |
| WO | 2004067964 | 8/2004 |
| WO | WO 2004067964 A1 * | 8/2004 |

OTHER PUBLICATIONS

"A magnetically driven PDMS micropump with ball check-valves", Tingrui Pan, et al., Journal of Micromechanics and Microengineering, 15 (2005) 1021-1026.

"Experimental study and modeling of polydimethylsiloxane peristaltic micropumps", Jacques Goulpeau, et al., Journal of Applied Physics, 98, 044914 (2005).

"Glass valveless micropump using electromagnetic actuation", Christophe Yamahata, et al., Science@Direct, Microelectronic Engineering 78-79 (2005) 132-137.

"Micromixing of Miscible Liquids in Segmented Gas-Liquid Flow", Axel Guenther, et al., Langmuir 2005, 21, 1547-1555, 2005 American Chemical Society.

"Monolithic Microfabricated Valves and Pumps by Multilayer Soft Lithography", Marc A. Unger, et al., www.sciencemag.org, Science vol. 288, Apr. 7, 2000.

"The VAMP—a new device for handling liquids or gases", M. Stehr, et al., Sensors and Actuators A 57 (1996) 153-157.

* cited by examiner

86
X
88
84
82
48
62
42
64
46
80
90
92
94
100
104
102
106
ν
ν=10Hz
5mm

FLUID HANDLING APPARATUS AND METHOD OF HANDLING A FLUID

CROSS-REFERENCE TO RELATED APPLICATION

This application claims priority from German Patent Application No. 10 2006 002 924.0, which was filed on Jan. 20, 2006, and is incorporated herein by reference in its entirety.

BACKGROUND OF THE INVENTION

1. Field of the Invention

The present invention relates to a fluid handling apparatus and a method of handling a fluid, and particularly to a fluid handling apparatus and a method of handling a fluid that are suited for handling a gaseous fluid in the field of microfluidics.

2. Description of the Related Art

For pumping fluids, i.e. gases and liquids, numerous functional principles are known in microfluidics. From Goulpeau, J. et al., "Experimental study and modeling of polydimethylsiloxane peristaltic micropumps.", Journal of Applied Physics 98, 044914, 2005; and Unger, M. A., et al., "Monolithic microfabricated valves and pumps by multilayer soft lithography," Science Vol. 288, 2000, pages 113-116, and EP 1065378 B1, it is known to employ elastomers, predominantly PDMS (polydimethylsiloxane), as an elastic membrane element and deflect the same for example by external pressure applied in a second channel plane, in order to handle liquids. Thereby, liquids may be displaced/pumped.

Magnetic deflection of such membrane elements in fluid handling apparatuses is also known. For example, Yamahata, C., et al., "A Ball Valve Micropump in Glass Fabricated by Powder Blasting", Sensors and Actuators B-Chemical 110 (2005), pages 1-7; and Yamahata, C., F. Lacharme, and M. A. M. Gijs. "Glass valveless micropump using electromagnetic actuation", Microelectronic Engineering 78-79 (2005), pages 132-137, disclose the employment of permanent magnets connected to an elastic membrane. For deflecting the membrane, an electromagnet is employed here.

A micropump disclosed in Pan, T. R., et al. "A magnetically driven PDMS micropump with ball check-valves" Journal of Micromechanics and Microengineering 15.5 (2005), pages 1021 to 1026 utilizes a permanent magnet attached on the spindle of a minimotor for periodic excitation of a magnetic plate disposed on a membrane of a micropump. The spindle rotates below the pumping chamber, so that the pump is operated at the rotational frequency of the motor.

From WO 97/10435 and from Stehr, M., et al., "The VAMP—A new device for handling liquids or gases" Sensors and Actuators A-Physical 57.2 (1996), pages 153-157, a check-valveless fluid pump is known, which comprises a pump body, a displacer in form of an elastic membrane, via which an opening can be closed and opened, and an elastic buffer adjoining a pump chamber formed in the pump body.

From Günther, A., et al., "Micromixing of miscible liquids in segmented gas-liquid flow", Langmuir 21.4 (2005), pages 1547-1555, a microfluidic system for efficient mixing of two miscible liquid flows by introducing a gas phase is known, which generates a segmented gas-liquid flow and completely separates the mixed liquid and gas flows in a planar capillary separator. Here, liquids and gases are introduced into microchannels by external pumps, wherein by suitable choice of the flow conditions at a joint a two-phase flow results, in which liquid and gas segments alternate along the channel. The segmented gas-liquid flow was visualized by the addition of a fluorescent dye to the liquid phase.

SUMMARY OF THE INVENTION

It is an object of the present invention to provide an alternative possibility for the actuation of a flexible membrane for handling fluids.

In accordance with a first aspect, the present invention provides a fluid handling apparatus, having: a body with a fluid handling structure; a flexible membrane attached to the body and formed to interact with a fluid in the fluid handling structure, wherein the membrane has a first actuation component; a second actuation component, wherein the first and second actuation components are formed such that the same attract or repel each other in a first positional relationship, in order to actuate the flexible membrane; and a driving means for moving the body relative to the second actuation component, in order to bring the first and the second actuation component into the first and out of the first positional relationship.

In accordance with a second aspect, the present invention provides a method of handling a fluid, with the steps of: providing a body, which has a fluid handling structure, and a flexible membrane attached to the body and formed to interact with a fluid in the fluid handling structure, wherein the membrane has a first actuation component; and moving the body relative to a second actuation component, in order to bring the first and the second actuation component into a first and out of the first positional relationship, in which the first and the second actuation component attract or repel each other, in order to actuate the flexible membrane.

Thus, according to the invention, a body in which a fluid handling structure is formed is moved relative to an actuation component, so as to thereby deflect a flexible membrane by repulsion or attraction, in order to thereby cause interaction with a fluid. The present invention is particularly suited for handling, e.g. pumping, gaseous fluids on a rotating body, without having to provide active devices, such as pumps, on the rotating body.

In embodiments of the invention, the fluid handling structure may define a microfluidic valve or a microfluidic pump together with the flexible membrane.

In one embodiment of the invention, the first actuation component and the second actuation component are formed to cause magnetic actuation. Here, the flexible membrane at least partially comprises a magnetic or magnetizable (paramagnetic or diamagnetic) material, e.g. metal. For example, the membrane may comprise magnetically passive paramagnetic steel laminae for transfer of forces, in order to actuate the membrane. The second actuation component may be a statically attached magnet, so that the membrane is deflected when the magnet passes.

In alternative embodiments of the invention, the first actuation component may comprise an electrostatically attractable or electrostatically repellable material, in order to enable electrostatic actuation with a matching second actuation component.

In embodiments of the invention, the first actuation component is integrated into an elastic lid foil providing a seal of microfluidic channels.

In one embodiment of the invention, the driving means is formed to effect rotation of the body with the flexible membrane attached thereto, in order to effect this relative to the second actuation component, which may be statically attached. By the rotation, a periodic deflection of the membrane may thereby be caused each time the second actuation means passes.

In one embodiment of the invention, the fluid handling structure comprises a cavity, into which the membrane is deflected when actuating, so as to thereby cause volume displacement.

In one embodiment, the body may comprise a plurality of fluid handling structures each associated with flexible membranes or a flexible membrane portion, so that by movement, for example rotation, of the body relative to the second actuation component, the plural membranes or the plural membrane portions can be deflected simultaneously or successively and thus be actuated. Hence, an individual, second actuation component may be used for actuating a plurality of membranes or membrane portions. If the second actuation component is sufficiently large, the plurality of membranes or membrane portions may also be actuated simultaneously.

In embodiments of the invention, the driving means is formed to effect rotational movement or accelerated translational movement of the body. In further embodiments of the invention, a liquid channel is also formed in the body, so that by the centrifugal force occurring in the rotational movement or the Euler force occurring in the accelerated translation, a liquid is forced through the liquid channel of the body. Thus, the movement of the body has a dual function, namely actuating the membrane on the one hand and forcing liquid through the liquid channel on the other.

The present invention is particularly suited for handling gases on rotating systems, on which also liquids are handled in centrifugal manner. In this respect, the present invention may provide an advantageous solution to the problem of pumping gas into a liquid channel on a rotating body, without having to provide an active gas pump working independently of the rotation on the body.

In this respect, in one embodiment of the invention, the fluid structure and the flexible membrane form a gas pump, which can be actuated by rotation of the body, in order to thereby pump gas into a liquid channel, through which a liquid is forced in centrifugal manner (by the rotation). An alternative principle for pressurizing (gaseous) fluids in centrifugal systems, which acts in hydrodynamically independent manner from the centrifugal force, but at the same time is very well consistent with the rotation of the microfluidic substrate both in terms of manufacture (no active elements) and by the actuation via the rotary motor itself, is not known. In such embodiments, the rotation thus has a dual function, on the one hand for centrifugally driving liquids and on the other hand for handling gaseous fluids by effecting actuation of a flexible membrane due to the rotation.

In such embodiments, in particular, the present invention enables the production of liquid-gas dispersions on a rotating platform (lab on a disc) using a centrifugal liquid drive. In this respect, the invention enables directional and displacement, which is periodically controlled by rotation, of a discrete gas volume on a rotating platform into a liquid channel, to thereby effect, in the channel, a segmented flow in which the liquid is divided into segments separated from each other by gas bubbles.

In embodiments of the present invention, the actuation of the membrane represents a reversible deflection thereof, i.e. the membrane returns to its home position after actuating the same. The return force required for this may be provided by an elasticity of the membrane. Alternatively, an external device may be provided to supply this return force, for example another actuation means (e.g. a magnet) that is arranged to bring the membrane back to the home position from the deflected one.

BRIEF DESCRIPTION OF THE DRAWINGS

These and other objects and features of the present invention will become clear from the following description taken in conjunction with the accompanying drawings, in which.

DESCRIPTION OF THE PREFERRED EMBODIMENTS

Before going into the figures individually in greater detail, it is at first to be pointed to the fact that the figures are of schematic nature and thus not drawn to scale.

Figure 1A:
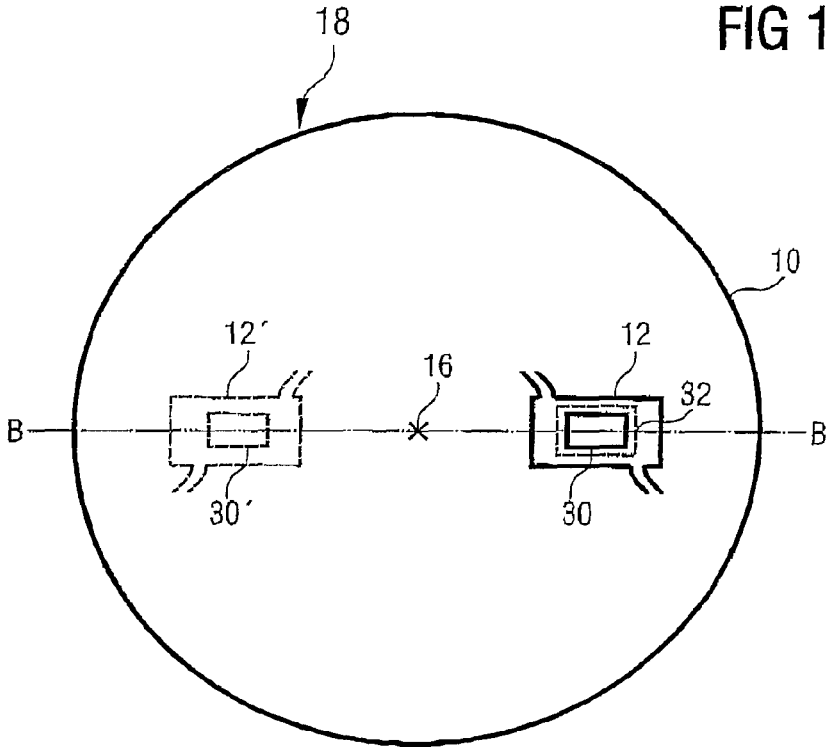
FIG. 1*a* is a schematic plan view onto one embodiment of a fluid handling apparatus according to the invention.
Figure 1B:
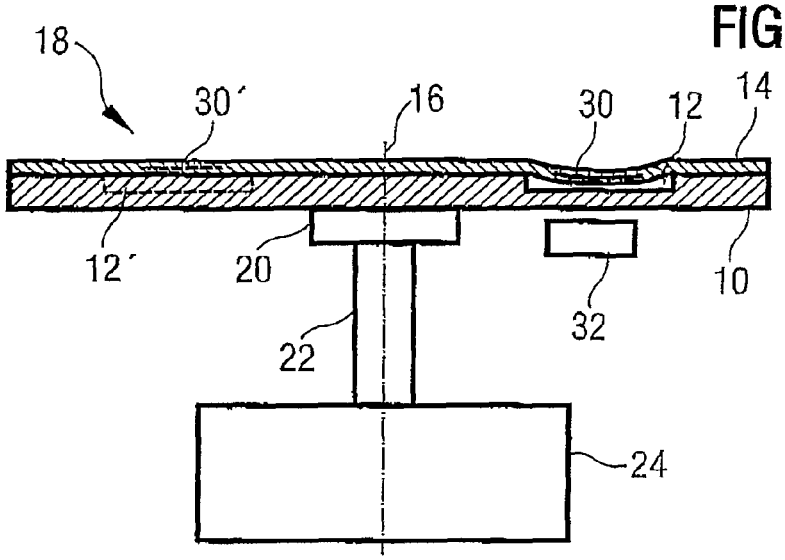
FIG. 1*b* is a schematic sectional view along the line B-B of FIG. 1*a;*

The embodiment of a handling apparatus according to the invention shown in FIGS. 1*a* and 1*b* includes a substrate 10, in which a fluid handling structure 12 is formed. On the top side of the substrate 10, a flexible membrane 14 is attached, on the whole area in the embodiment shown. The fluid handling structure 12 and the flexible membrane 14 are formed to enable interaction with a fluid, wherein the same may define arbitrary conventional fluidic components, for example pumps or valves. In the embodiment shown, the substrate 10 and the flexible membrane 14 fore a rotation body 18 rotatable around a rotation axis 16. Alternatively, the substrate and the flexible membrane may be formed in a module that can be inserted into a rotor, via which rotation of the module may be effected.

The rotation body 18 is held at a shaft 22, which can be driven by a motor 24, via a fixture 20. The fixture 20, the shaft 22, and the motor 24 thus represent a driving means, which may for example be formed by a conventional centrifuge, which enables controlled rotation of the rotation body.

An actuation component 30 is provided in form of a paramagnetic steel lamina in the membrane 14 above the fluid handling structure 12, wherein the membrane 14 is illustrated in translucent manner except for the actuation component 30 in FIG. 1*a*. The paramagnetic steel lamina 30, together with a magnet 32, enables actuation of the membrane 14 by the magnet repelling or attracting the region of the membrane lying above the fluid handling structure 12 if the steel lamina 30 and the magnet 32 are arranged opposite each other, as this is shown in FIGS. 1*a* and 1*b*. If the rotation body 18 is rotated relative to the stationary magnet 32 from the positional relationship, as it is shown in FIGS. 1*a* and 1*b*, so that the lamina 30 and the magnet 32 no longer are opposite each other, the actuation ends, and the membrane 14 returns to the non-deflected state. Thus, by moving the body 10 relative to the stationary magnet 32, the membrane arranged above the fluid handling structure 12 is reversibly actuated.

The substrate 10 may consist of any suitable material, for example silicon, ceramics, glass, or a polymer material. The membrane may consist of any suitable material offering the required flexibility and elastic return force, if applicable, for example of polydimethylsiloxane.

As indicated in FIG. 1*a*, a second fluid handling structure 12' may further be formed in the substrate 10, with which a membrane portion of the membrane 14 is associated, in which in turn an actuation component 30' is arranged. The membrane region arranged above the fluid handling structure 12' thus may be actuated by rotating the rotation body 18 from the position shown by 180 degrees, so that the actuation component 30' is opposite to the magnet 32. At this point, it is to be noted that a larger number of corresponding structures also may be formed in the rotation body, wherein the same will preferably be formed in rotation-symmetrical manner. By the rotation of the rotation body 18 via the static magnet, interaction with a fluid present in the corresponding fluid handling structures may thus be triggered periodically.

Figure 2:
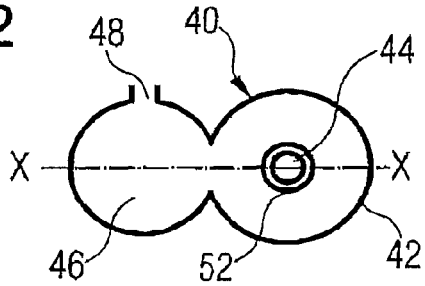
FIG. 2 is a schematic plan view onto fluid handling structures of one embodiment of a fluid handling apparatus according to the invention.

In preferred embodiments of the present invention, The fluid handling structure and the associated membrane region are formed to implement a pump. Such an embodiment and its functioning will be explained subsequently with reference to FIGS. 2 and 3.

The fluid handling structure 40 of the pump includes a valve chamber 42 with, in this embodiment, a perpendicular inlet 44 to the ambient air. The valve chamber 42 is connected to a pumping chamber 46, which has an outlet 48 leading into a microchannel. These fluid handling structures 40 are structured into a substrate 50, as can be taken from FIGS. 3*a* to 3*d*, wherein at this point it is to be pointed to the fact that only a small portion of the substrate is illustrated there. Around the inlet 44, a raised ring 52 serving as valve seat is provided. As can also be seen in FIGS. 3*a* to 3*d*, the bottom of the fluid handling structure 40 in the region of the pumping chamber may comprise structurings, which are not illustrated in FIG. 2 for clarity reasons. Such structurings may for example comprise a stop 54.

On the substrate, covering the valve chamber 42 and the pumping chamber 46, a flexible membrane 60 in which a first actuation component 62 in a membrane portion associated with the valve chamber 42 and a second actuation component 64 in a membrane portion associated with the pumping chamber 46 are formed, is provided. The actuation components 62 and 64 may for example be formed by temporarily magnetizable metal laminae. The membrane 60 is attached to the substrate 50 in regions outside the fluid handling structures, wherein the regions arranged above the fluid handling structures are flexible.

The timeline of a pumping cycle is illustrated in FIGS. 3*a* to 3*d*, which show the movement of the substrate 50 relative to a stationary magnet 66 along a direction of movement 68.

Figure 3A:
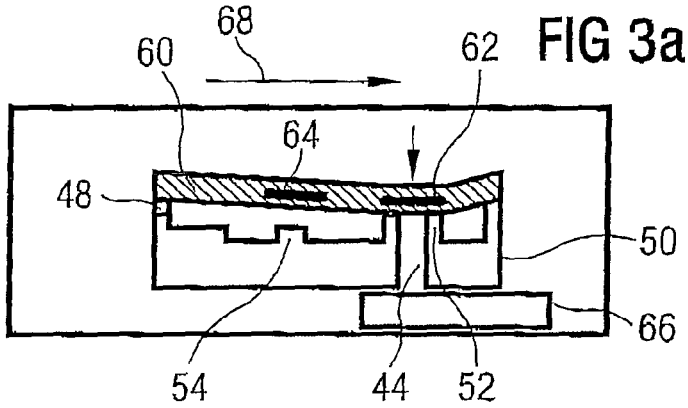
FIGS. 3*a* to 3*d* are schematic cross-sectional views along the line X-X of FIG. 2.
Figure 3B:
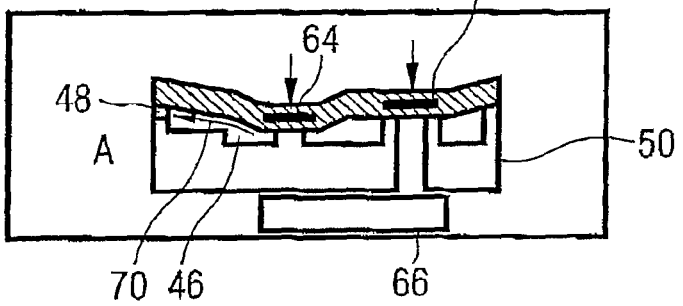
Figure 3C:
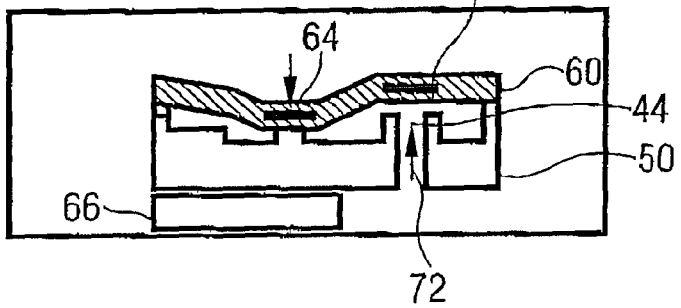
Figure 3D:
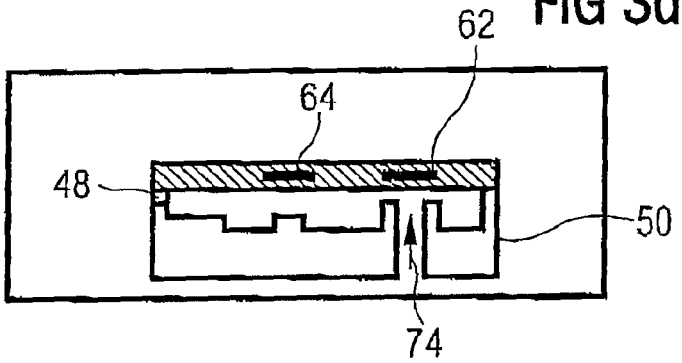

From a non-actuated state, the substrate 50 is moved to the right via the magnet 66, as shown in FIG. 3*a*. Thereby, the metal lamina 62 is attracted by the magnet 66. Thereby, the membrane region in which the metal lamina is formed is deflected downward, so that the membrane 60 rests on the valve seat 52 and thus closes the inlet 44. The membrane 60, which may for example consist of PDMS, serves as a sealing element here. If the substrate 50 is moved further to the right starting from this situation, the magnet 66 comes below the second metal lamina 64, so that the same is attracted, and the associated region of the membrane is deflected downward. Thus, a fixed volume of fluid present in the valve chamber 46 is displaced from the pumping chamber 46 through the outlet 48, as hinted at by an arrow 70 in FIG. 3*b*. Here, the valve is still closed, since the magnet 66 now deflects both metal laminae 62 and 64 downward.

In a further movement to the right, the magnet 66 now releases the first metal lamina 62, so that the membrane in the associated region relaxes and releases the inlet 44. Thereby, a fluid volume is sucked through the inlet 44, as shown by an arrow 72 in FIG. 3*c*. Then, the substrate 50 moves further to the right, so that the actuation of the membrane portion associated with the second metal lamina 64 also ends and the membrane also relaxes there. Hence, the pumping chamber again occupies its original volume, see FIG. 3*d*. It is of importance here that the pumping channel, through which the displaced volume from the pumping chamber 46 is pumped, has high fluidic resistance as opposed to the inlet, the perpendicular valve in the example shown, so that over a complete pumping cycle in the overall balance net air is sucked into the inlet 44 (see arrows 42 and 74 in FIGS. 3*c* and 3*d*) and expelled from the outlet 48.

In order to support the relaxation of the membrane, the actuation components may be formed as spring laminae, for example spring steel laminae.

Figures 4A, 4B, 4C:
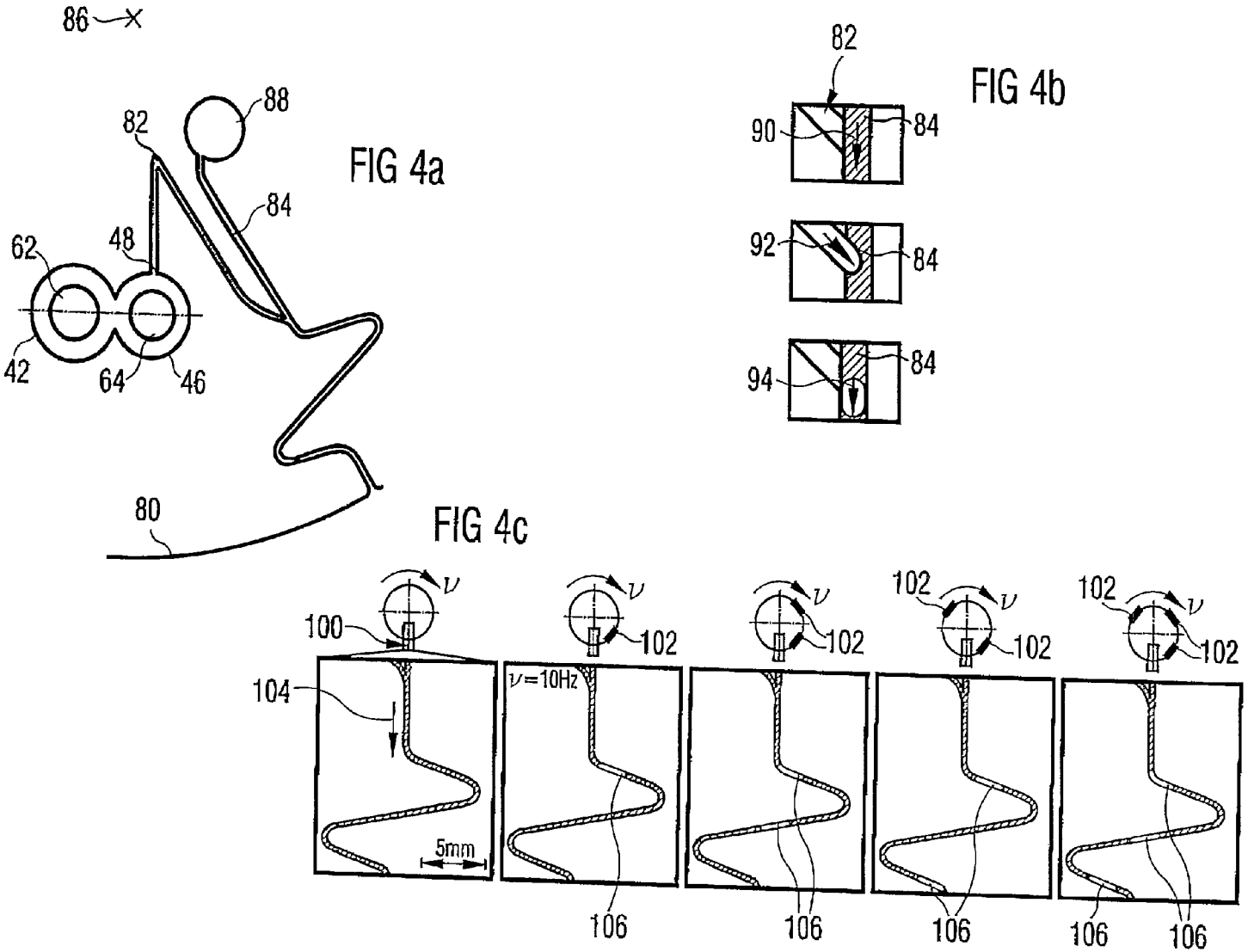
FIG. 4*a* schematically shows fluid handling structures of one embodiment of the invention.
FIG. 4*b* shows enlarged illustrations of an orifice region of the structure shown in FIG. 4*a;*
FIG. 4*c* schematically shows depictions for illustrating different liquid-gas flows.

One embodiment of the invention for producing a segmented liquid-gas flow will now be described with reference to FIGS. 4*a* to 4*c*. Here, for example, a pump, as it is has been described above with reference to FIGS. 2 and 3, may be used. Alternatively, another microfluidic pump could be used, which can be actuated by deflecting a membrane and works according to a conventional principle except for the actuation of the membrane, e.g. a peristaltic pump or a pump using a pumping chamber with check vales at an inlet and at an outlet of the pumping chamber.

FIG. 4 schematically shows a plan view onto a rotation body 80 comprising a pump, as it has been described above with reference to FIGS. 2 and 3, with valve chamber 42, pumping chamber 46, outlet 48, and actuation components 62 and 64.

The outlet 48 is connected to a fluid channel 82, which leads into a liquid channel 84. In a rotation of the rotation body 80 around a rotation axis 86, liquid from a reservoir region 88 is forced outward through the liquid channel 84 in centrifugal manner. In a given frequency working range, a gas volume displaced by the pump is pumped into the liquid flow through the liquid channel 84 via the stationary magnet (see 66 in FIGS. 3*a* to 3*d*) in each rotation of the pump and purged outward radially along the channel 84. Enlarged illustrations of the orifice location between the gas channel 82 and the liquid channel 84 are shown in FIG. 4*b* here. By the centrifugal force, a continuous fluid flow 90 is effected radially outward through the liquid channel 84. When actuating the pump, a gas volume 92 is pumped into the channel 84 through the channel 82, as can be taken from the middle illustration of FIG. 4*b*, which is then driven radially outward as a gas bubble 94 by the ensuing liquid in the channel 84, as shown in the lower illustration of FIG. 4*b*. Thereby, it is possible to produce segmented gas-liquid flows exhibiting liquid and gas segments arranged sequentially along the channel.

If several magnets are positioned along the orbit of the pump, the number of gas bubbles generated per revolution may be increased and also the length of the liquid segments along the channel adjusted. This is illustrated in the sub-images of FIG. 4*c*, which show, among other things, photographic pictures of the liquid channel 84 after the junction of the fluid channel 82, with the rectangle 100 depicting the camera position in the sub-images, whereas the rectangles 102 represent magnet positions. In a clockwise rotation at a rotation frequency of $\nu$=10 Hz, periodically pumping a respective amount of air into a continuously flowing liquid flow 104 takes place. The gas bubbles are each designated with the reference numerals 106 in FIG. 4*c*. As can be seen, the liquid is subdivided into segments, which are separated from each other in space along the channel by the gas bubbles, wherein the length of the liquid segments may be adjusted by the position and number of the magnets 102.

Figure 5:
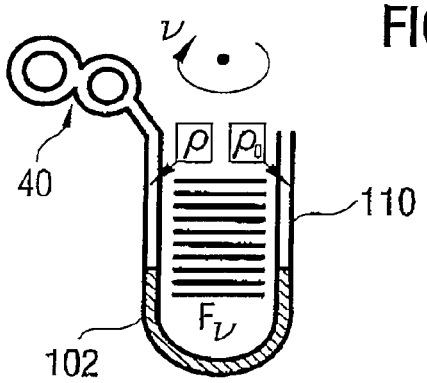
FIGS. 5 to 7 are schematic depictions for illustrating a measurement principle of the pumping pressure.
Figure 6:
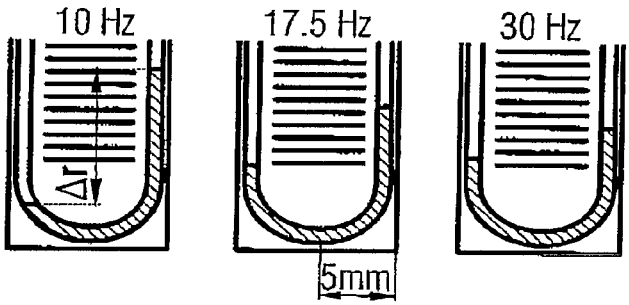
Figure 7:
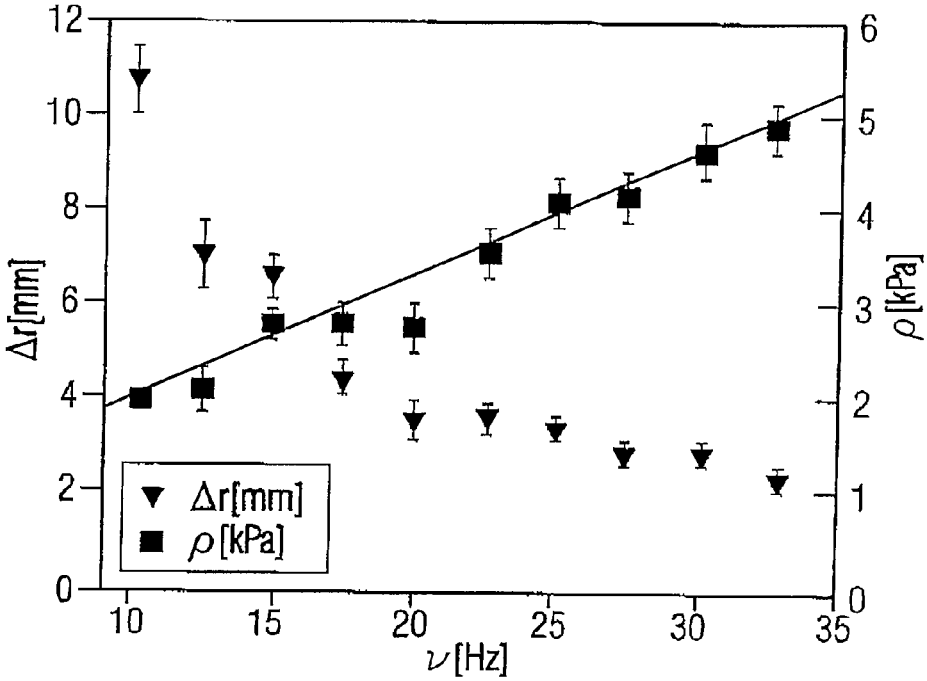

FIGS. 5 to 7 show the experimental characterization of the micropump described above with reference to FIGS. 2 and 3. The outlet of the microfluidic pump 40 was connected to a U-shaped channel 110, and water 102 colored with ink was filled into the U-shaped channel. Without magnet below the pump, i.e. without actuation of the pump, then only the centrifugal force $F_v$ radially directed outward acts under rotation (see line ν in FIG. 5), which balances out the two water-air menisci in the two symmetrical arms of the channel at equal height.

If the magnet is positioned below the rotating disc in which the structures mentioned are formed so that the pump passes it during the rotation, an increase in pressure develops per revolution, which leads to deflection of the head of water toward the right channel arm, if applicable. If this periodic deflection is observed in stroboscopic manner at a fixed angular position shortly after passing the magnet, a quasi-static height difference of the two interfaces results, which corresponds to the fixedly defined (as long as complete deflection in the pumping chamber is assumed) gas volume displaced by the pump, taking the compressibility into account. The higher the rotation frequency ν, the greater the (hydrostatic) pressure, which is created by this filling level difference and which has to be applied by the pump.

Corresponding stroboscopic pictures for different rotation frequencies of 10 Hz, 17.5 Hz and 30 Hz are shown in FIG. 6. Furthermore, in FIG. 1 the filling level difference Δr and the centrifugal pressure p corresponding to this difference are illustrated over the rotation frequency ν.

As an alternative to the above-described pump, the inventive approach could be used together with a pump, as it is described in WO 97/10435 A2. The valve pump described there includes a pump body and a deflectable membrane, which are formed such that a pumping chamber, which can be fluidically connected to an inlet and an outlet via a first and a second opening, is defined therebetween. An elastic buffer adjoins the pumping chamber. The deflectable membrane closes the first opening, when it is in the first adjustment, and leaves the first opening open, when it is in the second adjustment. When opening the first opening, at first no fluid is sucked into the two openings, but only the buffer is deflected. In the relaxation of the buffer, fluid is sucked into the two openings. Then the first opening is closed again, with the displaced volume again storing in the buffer. In the last step, the buffer again relaxes, and the volume "stored" therein is expelled through the second opening, since the first opening is closed. Thus, a net flow from the first opening to the second opening develops.

The disclosure of WO 97/10435 A2 is thus incorporated herein by reference with respect to the construction and the functionality of such a pump.

In the inventive employment, the membrane of such a pump would be actuated, instead of the piezoelectric actuation taught in WO 97/10435 A2, by equipping the membrane with a corresponding actuation component and then moving the valve body in the inventive manner relative to a matching actuation component, so that the deflection of the membrane required for reaching the pumping action occurs.

A further embodiment of an inventive fluid handling apparatus is a fluidic valve. Here, again an actuation component integrated into a membrane, for example a paramagnetic metal lamina, is deflected when passing a static second actuation component, for example a static permanent magnet. As a result of this deflection, the closure of the valve opening is effected. In this manner, fluid flows can be interrupted during the short moment of passing and thus be switched periodically. As an alternative thereto, a normally closed version of such a valve is possible. Here, the membrane is biased in the non-excited state over the valve seat. In a magnetically effected deflection, the membrane moves from the valve seat and the valve opens temporarily.

The above-described embodiments function using magnetic attraction, in order to effect deflection of a flexible membrane and thus actuation, wherein the actuation component arranged in the membrane is not a permanent magnet. The operation of the electromagnet may for example be synchronized with the rotation of the body containing the fluid handling structure, so that whenever the actuation component of the flexible membrane passes the same, the required magnetic field is provided.

Preferably, the stationary actuation component represents a magnetic field source, which may for example be implemented by a permanent magnet or an electromagnet.

When using a permanent magnet, the actuation means consisting of first and second actuation components may be deactivated (or switched off) by removing the second actuation component (for example moved downward in the example shown in FIG. 1*b*) such that the first and second actuation components are no longer brought to the first positional relationship by the movement of the first actuation component. In this respect, in embodiments of the present invention, a handling means may be provided, which is capable of moving the second actuation component between an inactive and an active position.

Alternatively, a permanent magnet may be provided in the membrane, wherein then deflection of the membrane may be realized by magnetic attraction or magnetic repulsion.

By using an electromagnet, activating and deactivating the actuation means may simply be effected by switching the electromagnet on and off. Furthermore, the use of an electromagnet also enables arbitrary modulation of the magnetic field generated thereby in simple manner.

As an alternative to magnetic attraction or repulsion, the present invention may also be implemented using electron static attraction or repulsion, wherein corresponding apparatuses have to be provided so as to apply the charges required for this to the actuation component of the flexible membrane and the stationary actuation component.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. A fluid handling apparatus, comprising: a body comprising a fluid handling structure; a flexible membrane attached to the body and formed to interact with a fluid in the fluid handling structure, wherein the membrane contains a first actuation component; a second actuation component, wherein the first and the second actuation component are formed such that the same attract or repel each other in a first positional relationship, in order to actuate the flexible membrane; and in addition to the first and second actuation components, a drive for moving the body relative to the second actuation component, in order to bring the first and the second actuation component from a positional relationship in which same do not attract or repel each other into the first positional relationship and out of the first positional relationship into the positional relationship in which same do not attract or repel each other, wherein the first and second actuation components are formed to actuate the membrane by magnetic or electrostatic attraction or repulsion.

2. The fluid handling apparatus of claim 1, wherein the drive is formed to effect rotational movement or accelerated translation of the body, in order to bring the first and the second actuation component into and out of the first positional relationship.

3. The fluid handling apparatus of claim 2, wherein the body further comprises a liquid channel, wherein the drive is formed to move the body so that, apart from the actuation of the flexible membrane, also a liquid is forced through the liquid channel.

4. The fluid handling apparatus of claim 1, wherein the fluid handling structure and the flexible membrane form a valve, wherein the fluid handling structure comprises a fluid passage that can be opened or closed by the actuation of the flexible membrane.

5. The fluid handling apparatus of claim 3, wherein the fluid handling structure and the flexible membrane form a fluid pump formed to pump a fluid by the actuation of the flexible membrane.

6. The fluid handling apparatus of claim 5, wherein the fluid pump is fluidically connected to the liquid channel, so that a fluid is pumped into the liquid in the liquid channel by means of the fluid pump by the movement of the body by the drive.

7. The fluid handling apparatus of claim 6, comprising one or more second actuation components, wherein the drive is formed to sequentially bring the first actuation component into the first positional relationship with the second actuation component or components, so that several fluid regions separated from each other are produced in a liquid forced through the liquid channel.

8. A fluid handling apparatus comprising:

a body comprising a fluid handling structure;

a flexible membrane attached to the body and formed to interact with a fluid in the fluid handling structure, wherein the membrane comprises a first actuation component;

a second actuation component, wherein the first and the second actuation component are formed such that the same attract or repel each other in a first positional relationship, in order to actuate the flexible membrane; and a drive for moving the body relative to the second actuation component, in order to bring the first and the second actuation component into the first and out of the first positional relationship, wherein the body comprises a plurality of fluid handling structures, each associated with a flexible membrane or a flexible membrane region with a first actuation component, wherein the apparatus is formed such that the flexible membranes or flexible membrane regions can be actuated simultaneously or sequentially by the second actuation component, and wherein the fluid handling structures define a valve chamber and a pumping chamber, which are fluidically connected, wherein the valve chamber comprises an inlet opening and wherein the pumping chamber comprises an outlet, wherein flexible membrane regions each having a first actuation component adjoin the valve chamber and the pumping chamber, wherein the drive is formed to move the body past the second actuation component such that, by actuating the actuation component associated with the valve chamber, the inlet opening is closed, and then, by actuating the actuation component associated with the pumping chamber, a fluid volume is expelled through the outlet, while the actuation component associated with the valve chamber remains actuated.

9. A method of handling a fluid, comprising the steps of: providing a body, which comprises a fluid handling structure, and a flexible membrane attached to the body and formed to interact with a fluid in the fluid handling structure, wherein the membrane contains a first actuation component; and by a drive provided in addition to the first actuation component and a second actuation component, moving the body relative to the second actuation component, in order to bring the first and the second actuation component from a positional relationship in which the same do not attract or repel each other into a positional relationship, in which the same attract or repel each other, in order to actuate the flexible membrane, and in order to bring the first and the second actuation component from the positional relationship in which the same attract or repel each other into the positional relationship in which the same do not attract or repel each other, wherein the first and second actuation components are formed to actuate the membrane by magnetic or electrostatic attraction or repulsion.

10. The method of claim 9, wherein the movement of the body includes rotational movement or an accelerated translation of the body, in order to bring the first and the second actuation component into and out of the first positional relationship, wherein a liquid is forced through a liquid channel of the body by a centrifugal force caused by the rotational movement or by an Euler force caused by the accelerated translation.

11. A method of handling a fluid, comprising the steps of:

providing a body, which comprises a fluid handling structure, and a flexible membrane attached to the body and formed to interact with a fluid in the fluid handling structure, wherein the membrane comprises a first actuation component; and moving the body relative to a second actuation component, in order to bring the first and the second actuation component into a first and out of a first positional relationship, in which the first and the second actuation component attract or repel each other, in order to actuate the flexible membrane, wherein the fluid handling structure and the flexible membrane define a fluid pump, which comprises an outlet connected to a liquid channel, and wherein the step of moving the body comprises a step of rotating the same, so that by rotating a liquid is forced through the liquid channel in centrifugal manner, and the flexible membrane is actuated by rotating, in order to pump a fluid into the liquid in the liquid channel.

* * * * *